United States Patent [19]

Okada

[11] 4,217,539

[45] Aug. 12, 1980

[54] STABILIZED CURRENT OUTPUT CIRCUIT

[75] Inventor: Takashi Okada, Yokohama, Japan

[73] Assignee: Sony Corporation, Tokyo, Japan

[21] Appl. No.: 964,345

[22] Filed: Nov. 28, 1978

[30] Foreign Application Priority Data

Dec. 14, 1977 [JP] Japan ..... 52-150312

[51] Int. Cl.[2] ..... G05F 3/08

[52] U.S. Cl. ..... 323/4; 330/288

[58] Field of Search ..... 323/1, 4, 9; 307/297; 330/288

[56] References Cited

U.S. PATENT DOCUMENTS

| | | | |
|---|---|---|---|
| 3,320,439 | 5/1967 | Widlar | 323/4 |
| 3,781,648 | 12/1973 | Owens | 323/4 |
| 3,942,129 | 3/1976 | Hall | 330/288 X |
| 3,950,708 | 4/1976 | Hall | 330/288 X |
| 4,119,869 | 10/1978 | Hashimoto | 323/4 |

*Primary Examiner*—William H. Beha, Jr.

*Attorney, Agent, or Firm*—Hill, Van Santen, Steadman, Chiara & Simpson

[57] ABSTRACT

A stabilized current output circuit having a DC power source with a pair of terminals, a series circuit consisting of m number of diodes which is connected at one end thereof to one terminal of the DC power source and at the other end thereof to the other end of the DC power source, a first transistor forming a first current mirror circuit together with the last diode of the series circuit located nearest to the other terminal of the DC power source, the last diode being connected between the base and emitter of the first transistor, a first resistor connected between the first diode of said series circuit and said one terminal, a second resistor connected between the collector of the first transistor and the one terminal of the DC power source, a diode connected between the collector of the first transistor and the other terminal of the DC power source, and an output transistor which is connected at the base thereof to the collector of the first transistor. In this case, the output transistor and the last-mentioned diode form a second current mirror circuit, and the resistance values of the first and second resistors are selected in connection with the number m to produce a stabilized constant current at the collector of the output transistor.

4 Claims, 4 Drawing Figures

STABILIZED CURRENT OUTPUT CIRCUIT

BACKGROUND OF THE INVENTION

1. Field of the Invention

The present invention relates generally to a stabilized current output circuit, and is directed more particularly to a constant current output circuit which can produce an output current stable even when temperature is varied upon being driven at a low voltage.

2. Description of the Prior Art

In the art, as to a transistor circuit which will produce a constant current, there have been proposed current mirror circuits such as shown in FIGS. 1 and 2.

In the prior art current mirror circuit shown in FIG. 1, there is provided an NPN-type transistor 1 which is grounded at the emitter thereof and connected at the collector thereof to an output terminal 2 and another NPN-type transistor 3 which is connected in a diode form. The base of the transistor 1 is connected to the connection point between the collector and base of the transistor 3, i.e., the anode of the diode, and the emitter of the transistor 3, i.e., the cathode of the diode is grounded. The connection point between the collector and base of the transistor 3 is connected through a resistor 4 to a power source terminal 5 which is supplied with a positive DC voltage $V_{CC}$ so that a constant current $I_C$ flows to the transistor 1. In this case, if the emitter area of the transistor 1 is selected equal to that of the transistor 3 which is connected as a diode, the base-emitter voltage of the transistor 1 is taken as $V_{BE}$ and the resistance value of the resistor 4 is taken as $R_1$, respectively, the constant current $I_C$ is expressed as follows:

$$I_C = 1/R_1(V_{CC} - V_{BE}) \quad (1)$$

A prior art current mirror circuit is shown in FIG. 2, in which reference numerals are the same as those used in FIG. 1 to represent the same elements. The emitter of the NPN-type transistor 1 is grounded through a resistor 6, the base thereof is connected through a resistor 7 to the connection point between the collector and base of the transistor 3 which is connected in the form of a diode and is grounded at the emitter thereof and the base of the transistor 1 is connected through the resistor 4 to the power source terminal 5 which is supplied with the DC voltage of $V_{CC}$ similar to the example of FIG. 1, so that the constant current $I_C$ flows to the transistor 1. In this case, if the transistors 1 and 3 are selected equal in their emitter area and the resistance values of the resistors 7 and 6 are taken as $R_2$ and $R_3$, respectively, the constant current $I_C$ can be expressed as follows:

$$I_C = \frac{R_2}{R_3} \cdot \frac{1}{R_1 + R_2} (V_{CC}\ V_{BE}) \quad (2)$$

As may be apparent from the above equations (1) and (2), the constant current $I_C$ from the prior art constant current output circuits or current mirror circuits shown in FIGS. 1 and 2 is in proportion to $(V_{CC} - V_{BE})$. Accordingly, in the constant current output circuits shown in FIGS. 1 and 2, if the condition $V_{CC} > V_{BE}$ is satisfied, variation or fluctuation of the constant current $I_C$ caused by fluctuation of $V_{BE}$ of the transistor 1 depending upon temperature change can be neglected and hence it can be said that the constant current $I_C$ has no temperature characteristic.

However, when the power source voltage $V_{CC}$ is low and accordingly is not as high as compared with the base-emitter voltage $V_{BE}$ of the transistor 1, the output constant current $I_C$ depends upon the voltage $V_{BE}$ or is changed in accordance with the temperature characteristic thereof. Therefore, the prior art constant current output circuits shown in FIGS. 1 and 2 can not be said to be a stabilized constant current output circuit. In other words, when the power source voltage $V_{CC}$ becomes low, the prior art constant current output circuits shown in FIGS. 1 and 2 lose the constant current characteristics and hence can not be used practically.

OBJECTS AND SUMMARY OF THE INVENTION

Accordingly, an object of the present invention is to provide a novel transistor circuit or stabilized current output circuit which is free from the drawback inherent to the prior art transistor circuit or constant current output circuit.

Another object of the invention is to provide a stabilized current output circuit made of mainly transistors and diodes which is usable as a constant current circuit.

A further object of the invention is to provide a stabilized current output circuit which is a transistor circuit and produces a stabilized constant current irrespective of temperature variation even when the power source voltage is low.

According to an aspect of the present invention, there is provided a transistor circuit which comprises a DC power source having a pair of terminals a series circuit consisting of a first resistor and m number of diodes, said series circuit being connected at one end thereof to one terminal of said DC power source and at the other end thereof to the other terminal of said DC power source, a first transistor which forms a first current mirror circuit together with the last diode of said series circuit located nearest to said other terminal of said DC power source, said last diode being connected between the base and emitter of said first transistor, a second resistor connected between a collector of said first transistor and said one terminal of said DC power source, a diode connected between the collector of said first transistor and said other terminal of said DC power source, and an output transistor whose base is connected to the collector of said first transistor, said output transistor and last-mentioned diode forming a second current mirror circuit, wherein resistance values of said first and second resistors are selected in connection with said number m to produce a stabilized constant current at the collector of said output transistor.

The other objects, features and advantages of the present invention will become clear from the following description taken in conjunction with the accompanying drawings through which the like reference numerals designate the same circuit elements.

DESCRIPTION OF THE PREFERRED EMBODIMENT

The present invention will be hereinafter described with reference to the attached drawings.

Figure 1:
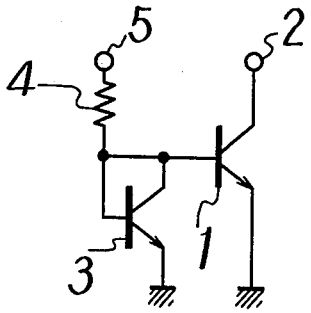
FIG. 1 (PRIOR ART)
FIGS. 1 and 2 are respectively connection diagrams showing prior art constant current output circuit or transistor circuits.
Figure 2:
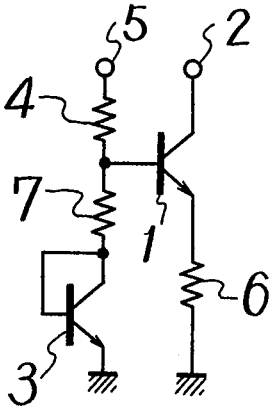
FIG. 2 (PRIOR ART)

First, a general example of the stabilized current output circuit according to the present invention will be described with reference to FIG. 3, in which reference numerals which are the same as those used in FIGS. 1 and 2 designate the same elements.

Figure 3:
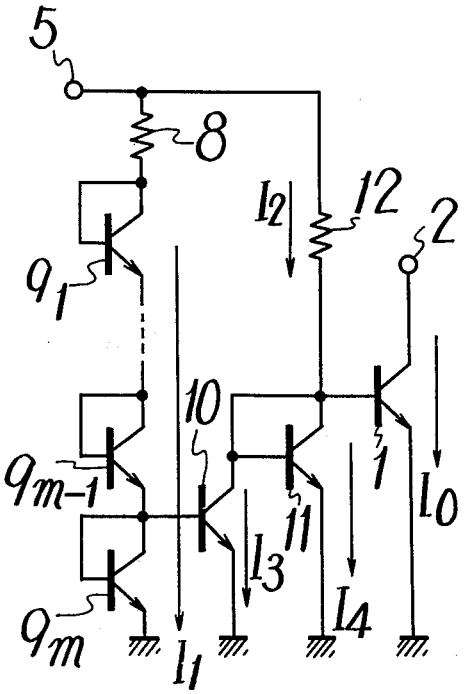
FIG. 3 is a circuit diagram showing a general example of the stabilized current output circuit made mainly of transistors and diodes according to the present invention.

As shown in FIG. 3, with the present invention, the power source terminal 5, which is supplied at one terminal with the positive DC voltage of $V_{CC}$, is grounded through a series connection of a resistor 8 and m number of NPN-type transistors $9_1, \ldots 9_{m-1}, 9_m$, each of which is connected in the form of a diode or diode-connected transistor. The connection point between the base and collector of the transistor $9_m$, which is located nearest the ground or the other terminal of the power source, is connected to the base of an NPN-type transistor 10 which is grounded at the emitter thereof. Thus, the transistor $9_m$, which is the diode-connected transistor, and the transistor 10 form a first current mirror circuit. The collector of the transistor 10 is connected to the connection point of the collector and base of an NPN-type transistor 11, which is connected in the form of a diode or diode-connected transistor, and is grounded at the emitter thereof. The connection point of the collector and base of the transistor 11 is connected through a resistor 12 to the power source terminal 5 and is also connected directly to the base of the NPN-type output transistor 1 which is grounded at the emitter thereof and connected at the collector thereof to the output terminal 2. In this case, another or second current mirror circuit is formed of the transistor 11, which is connected in the form of a diode, and the output transistor 1.

In the circuit shown in FIG. 3, if it is assumed that the transistors 1, $9_1, \ldots 9_{m-1}$, 10 and 11 are selected the same in characteristics; the emitter area ratio of the transistors $9_m$ and 10 is selected as 1:n; the emitter area ratio of the transistors 11 and 1 is selected as 1:l; the current flowing through the transistor $9_m$, when the base currents of the respective transistors 1, 10 and 11 are neglected, is taken as $I_1$; the current flowing through the resistor 12 as $I_2$; the currents flowing through the transistors 10 and 11 as $I_3$ and $I_4$; an output current as $I_0$; and the resistance values of the resistors 12 and 8 as $R_0$ and $R_5$, respectively, the following equations are established:

$$I_1 = \frac{V_{CC} - m\,V_{BE}}{R_5} \tag{3}$$

$$I_2 = I_3 + I_4 = \frac{V_{CC} - V_{BE}}{R_0} \tag{4}$$

$$I_3 = nI_1 \tag{5}$$

$$I_0 = lI_4 \tag{6}$$

From the above equations (3) to (6) there is derived the following equation (7).

$$\frac{n(V_{CC} - m\,V_{BE})}{R_5} + \frac{I_0}{l} = \frac{V_{CC} - V_{BE}}{R_0} \tag{7}$$

From the equation (7), the output current $I_0$ can be expressed as follows:

$$I_0 = l\left\{\frac{V_{CC} - V_{BE}}{R_0} - \frac{n(V_{CC} - m\,V_{BE})}{R_5}\right\} \tag{8}$$

The above equation (8) can be rewritten as follows:

$$I_0 = \left(\frac{1}{R_0} - \frac{n}{R_5}\right)V_{CC} + l\left(\frac{mn}{R_5} - \frac{1}{R_0}\right)V_{BE} \tag{9}$$

If it is assumed that the following equation (1) is satisfied to make the second term of the above equation (9) zero, $$R_5 = mnR_0 \tag{10}$$

the output current $I_0$ can be expressed as follows:

$$I_0 = l\frac{m-1}{m}\cdot\frac{1}{R_0}V_{CC} \tag{11}$$

It will be apparent that the above equation (11) has no relation to the base-emitter voltage $V_{BE}$ of each transistor. That is, if the equation (10), i.e., $R_5 = mnR_0$ is satisfied by selecting the resistance values $R_0$ and $R_5$ in the circuit of FIG. 3, the output current $I_0$ becomes stable irrespective of whether the power source voltage $V_{CC}$ is high or low and irrespective of temperature variation.

Figure 4:
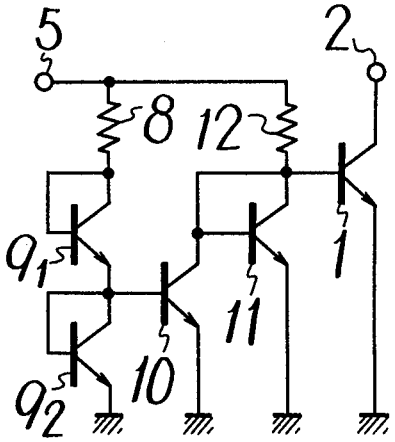
FIG. 4 is a connection diagram showing a simplest example of the stabilized current output circuit according to the invention.

FIG. 4 shows a practical or simplest example of the invention. In the example of the invention shown in FIG. 4, by way of example, m is selected 2 (m+2), i.e., two transistors $9_1$ and $9_2$, each of which is connected in the form of a diode, are used; n and l are both selected equal to 1 (n+1+1), and the resistance values $R_5$ and $R_0$ are selected to satisfy $R_5 = 2R_0$, respectively.

Accordingly, the output current $I_0$ of the example shown in FIG. 4 is expressed from the equation (11) as follows:

$$I_0 = V_{CC}/2R_0 \tag{12}$$

Therefore, from the equation (12), it will be apparent that the transistor circuit of the invention shown in FIG. 4 is a stabilized current output circuit which can produce the stable output current $I_0$ irrespective of whether the power source voltage $V_{CC}$ is high or low and of temperature variation.

It may be easily understood that diodes can be used in place of the transistors $9_1$ to $9_m$ and 11 used in the above example of the invention with the same effects.

The above description is given of preferred examples of the invention, but it will be apparent that many modifications and variations could be effected by one skilled in the art without departing from the spirit or scope of the novel concepts of the present invention.

I claim as my invention:

1. A stabilized current output circuit comprising:

(a) a DC power source having a pair of terminals;

(b) a series circuit consisting of a first resistor and m number of diodes, said series circuit being connected at one end thereof to one terminal of said DC power source and at the other end thereof to the other terminal of said DC power source;

(c) a first transistor which forms a first current mirror circuit together with the last diode of said series circuit located closest to said other terminal of said DC power source, said last diode being connected between the base and emitter of said first transistor;

(d) a second resistor connected between a collector of said first transistor and said one terminal of said DC power source;

(e) a diode connected between the collector of said first transistor and said other terminal of said DC power source; and (f) an output transistor whose base is connected to the collector of said first transistor, said output transistor and last-mentioned diode forming a second current mirror circuit, wherein resistance values of said first and second resistors are selected in connection with said number m to produce a stabilized constant current at the collector of said output transistor.

2. A stabilized current output circuit according to claim 1, wherein each of said m number of diodes and the last-mentioned diode is a diode-connected transistor where the collector and base thereof are connected to each other.

3. A stabilized current output circuit according to claim 2, wherein the emitter area ratio of said first transistor and said last diode-connected transistor of said series circuit is selected n:1, the emitter ratio of said output transistor and last mentioned transistor is selected l:1, and resistance values $R_5$ and $R_0$ of said first and second resistors are selected to satisfy $R_5 = mnR_0$.

4. A stabilized current output circuit according to claim 3, wherein the number m of said diodes in said series circuit is selected to be 2, the values l and n are both selected as 1, and the resistance value of said first resistor is selected to be twice as much as that of said second resistor.

* * * * *